US007628263B2

(12) United States Patent
Hirota et al.

(10) Patent No.: US 7,628,263 B2
(45) Date of Patent: Dec. 8, 2009

(54) STEP MECHANISM OF TRANSPORT DEVICE

(75) Inventors: Junichi Hirota, Hikone (JP); Kenro Matsuo, Hikone (JP); Masashi Tsuchihata, Hikone (JP)

(73) Assignee: Fujitec Co., Ltd., Hikone-shi (JP)

( * ) Notice: Subject to any disclaimer, the term of this patent is extended or adjusted under 35 U.S.C. 154(b) by 281 days.

(21) Appl. No.: 11/910,664

(22) PCT Filed: Mar. 13, 2006

(86) PCT No.: PCT/JP2006/305330

§ 371 (c)(1),
(2), (4) Date: Oct. 4, 2007

(87) PCT Pub. No.: WO2006/106604

PCT Pub. Date: Oct. 12, 2006

(65) Prior Publication Data

US 2009/0266675 A1 Oct. 29, 2009

(30) Foreign Application Priority Data

Apr. 4, 2005 (JP) ..... 2005-107409

(51) Int. Cl.
*B66B 21/08* (2006.01)

(52) U.S. Cl. ..... 198/333; 198/326

(58) Field of Classification Search ..... 198/326–333
See application file for complete search history.

(56) References Cited

U.S. PATENT DOCUMENTS

| | | | | |
|---|---|---|---|---|
| 4,638,901 A * | 1/1987 | Lunardi | ..... | 198/323 |
| 5,439,090 A * | 8/1995 | Findlay | ..... | 198/333 |
| 6,241,071 B1 * | 6/2001 | Yamashita et al. | ..... | 198/333 |
| 6,398,003 B1 * | 6/2002 | Jasinetzky | ..... | 198/333 |
| 6,543,599 B2 * | 4/2003 | Jasinetzky | ..... | 198/333 |

FOREIGN PATENT DOCUMENTS

| | | | | |
|---|---|---|---|---|
| JP | 57137821 A | 8/1982 | | |
| JP | 6241184 A | 2/1987 | | |
| JP | 03249089 A * | 11/1991 | ..... | 198/333 |
| JP | 11263575 A | 9/1999 | | |

OTHER PUBLICATIONS

International Search Report of PCT/JP2006/305330, date of mailing Jul. 4, 2006.

* cited by examiner

*Primary Examiner*—Mark A Deuble
(74) *Attorney, Agent, or Firm*—Westerman, Hattori, Daniels & Adrian, LLP

(57) ABSTRACT

A transport device includes a plurality of endlessly connected steps (1) so that these steps (1) circulate. One or more of the plurality of steps (1) have one or more weights (11) detachably attached thereto. These weights (11) are contained in the space surrounded by a tread (2), a riser (4), and a yoke (3) that form each of the steps (1), and supported on the rear surface of the tread (2) in a row by a channel member (12) of U-shape in cross section.

5 Claims, 7 Drawing Sheets

STEP MECHANISM OF TRANSPORT DEVICE

TECHNICAL FIELD

The present invention relates to a circulating transport device such as an escalator or a moving walk.

BACKGROUND ART

A circulating transport device such as an escalator includes a plurality of endlessly connected steps 9 made of aluminum alloy, each including a tread 2, a pair of right and left yokes 3, 3 and a riser 4, as shown in FIG. 7 and FIG. 8. These steps 9 circulate to transport objects put on the steps 9. Each step 9 has guide rollers 7, 8 attached to the front and back thereof, which guide movement of the step 9.

Circulating transport devices such as escalators undergo generally operation tests to continuously operate under an unloaded condition, and, if necessary, load tests with a weight such as a sand bag put on the step.

In noise tests of a driving machine, noise has been measured under various load conditions changed by a DC motor connected to the output side of the speed reducer (JP 57-137821, A).

However, in load tests of conventional circulating transport devices, although they can be temporarily loaded, it is physically impossible for them to continuously operate while being loaded. Thus, there has been a problem in that it is extremely difficult to verify the durability of the driving system or guide system under a load condition.

Accordingly, an object of the present invention is to provide a step mechanism of a circulating transport device that can undergo load tests to continuously operate with its step being loaded.

DISCLOSURE OF THE INVENTION

The present invention provides a transport device such as an escalator including a plurality of steps 1 endlessly connected to circulate, wherein one or more of the steps 1 have one or more weights 11 detachably attached thereto.

The one or more weights 11 are contained in the space surrounded by a tread 2, a riser 4, and a yoke 3 that form each of the steps 1, and disposed on the rear surface of the tread 2.

These plurality of weights 11 are fixed to the rear side of the tread 2 in a row by a channel member 12 of U-shape in cross section, with a projection 16 formed on the back face of each of the weights 11 being fitted in a groove of the channel member 12.

When a load test is conducted of the transport device of the present invention, one or more weights 11 are attached to one or more of the steps 1, and then the device continuously operates while being loaded. The steps 1 circulate smoothly because the one or more weights 11 are contained in the space surrounded by the tread 2, riser 4, and yoke 3 that form each of the steps 1. After the completion of the load test, all the weights 11 are detached from the steps 1.

As described above, the step mechanism of the transport device in accordance with the present invention can undergo continuous load operation tests with its step being loaded. This can be helpful in verifying the durability or reliability of the driving system or guide system of the steps, and in improving component performance.

BEST MODE FOR CARRYING OUT THE INVENTION

With reference to the drawings, an escalator will be specifically described below where the step mechanism of a transport device in accordance with the present invention is embodied.

Figure 1:
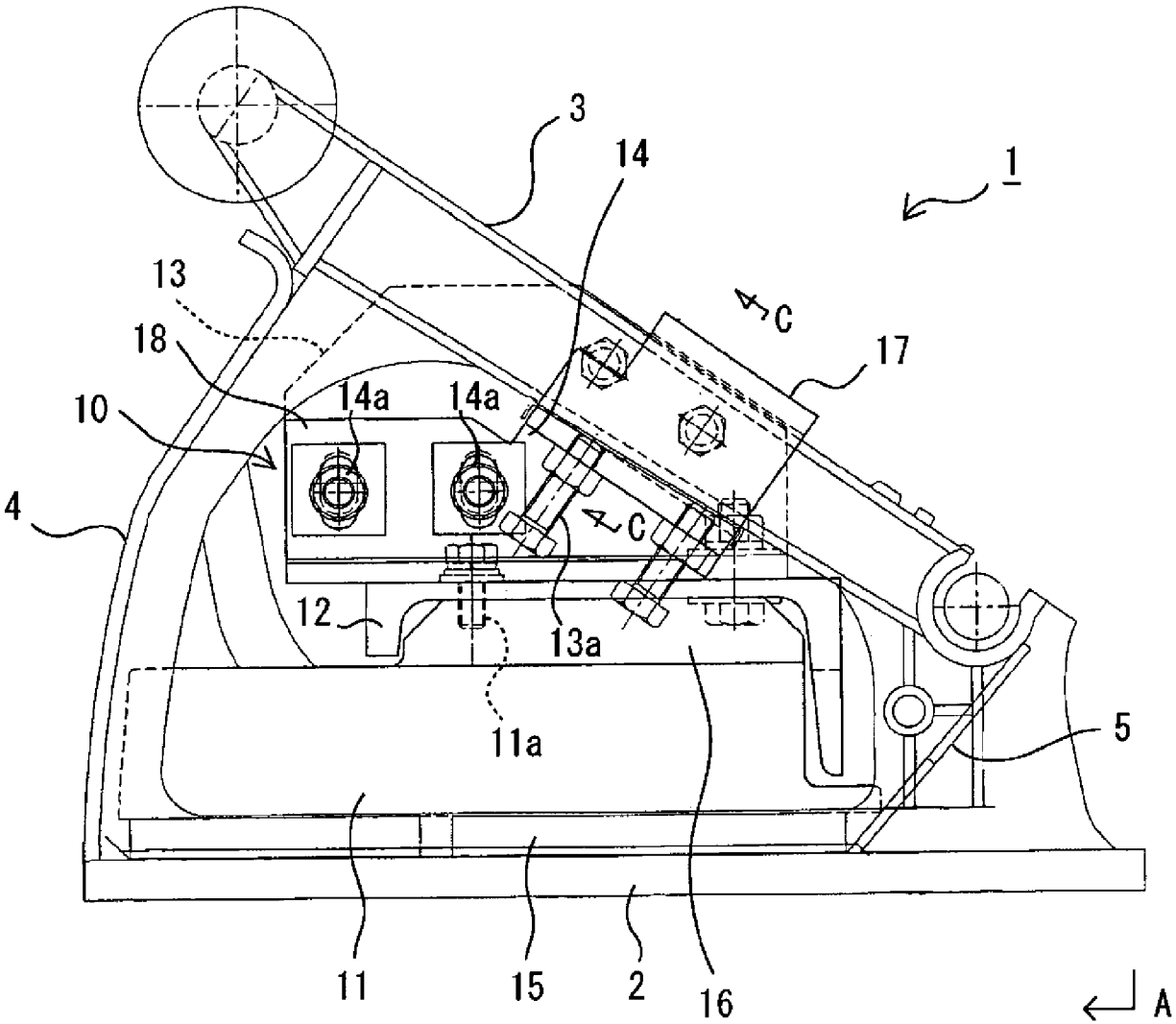
FIG. 1 is a side view of a step of a transport device in accordance with the present invention at the time when the step is moving on the return side in the process of its circulation.

When the escalator in accordance with the present invention undergoes a load test, a plurality of (for example, eight) weights 11 are attached to a step 1, as shown in FIG. 1. After the completion of the load test, all the weights 11 are detached from the step 1. Each of the weights 11 is limited to a weight of around 15 kg for easy handling.

Figure 8:
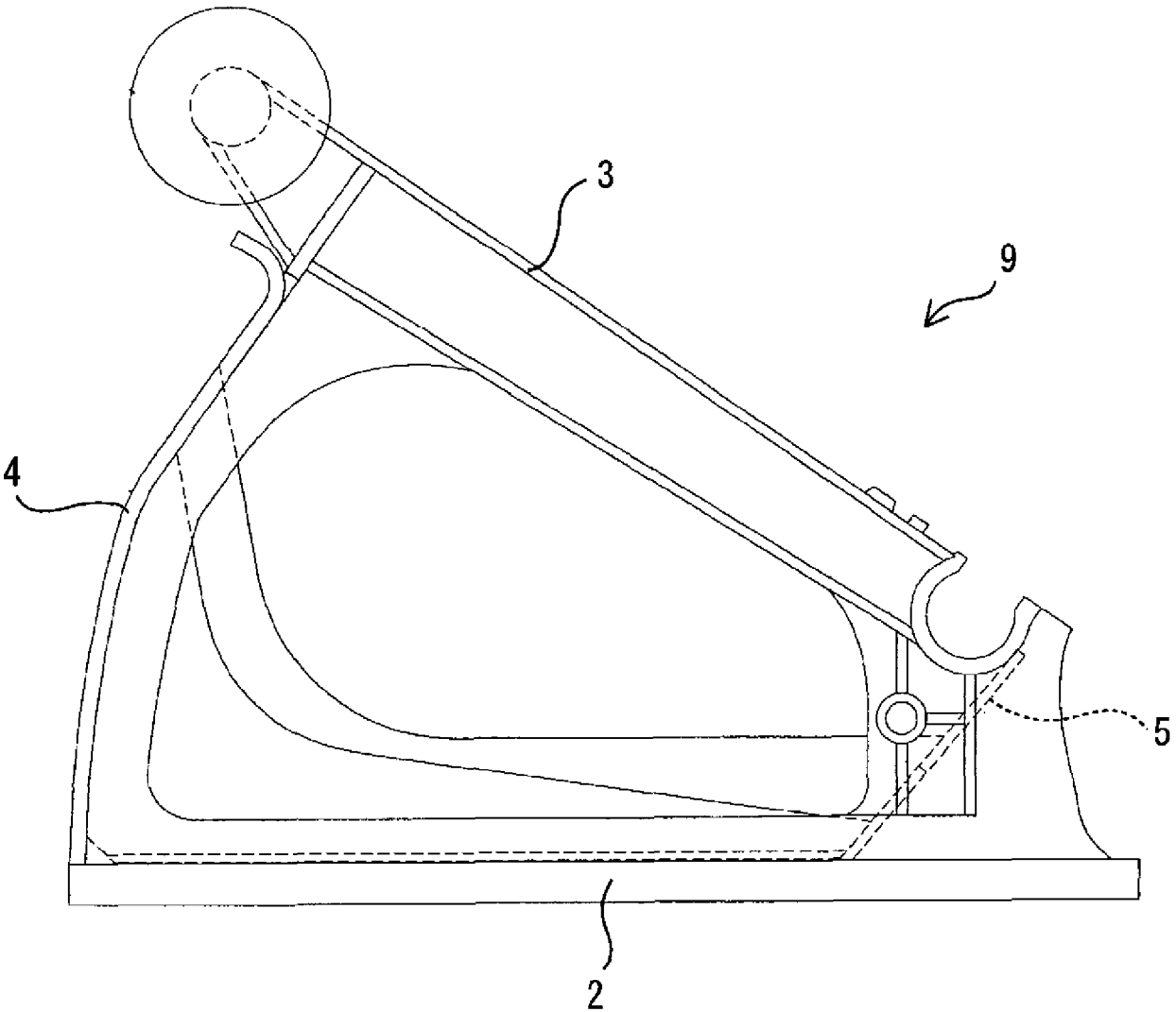
FIG. 8 PRIOR ART
FIG. 8 is a side view of the conventional step at the time when the step is moving on the return side in the process of its circulation.

The step 1 includes a tread 2, a pair of right and left yokes 3, 3 and a riser 4, as the conventional step 9 shown in FIG. 8 does. The tread 2 is formed in the shape of a flat plate, each yoke 3 of a column of U-shape in cross section, and the riser 4 of a circular arc surface. In the conventional step 9, the space in the shape of a triangular prism surrounded by the tread 2, yokes 3, 3 and riser 4 is a useless space, whereas in the step 1 in accordance with the present invention, this space contains a weight device 10 including the plurality of weights 11 and a plurality of members for attaching the weights 11.

Figure 2:
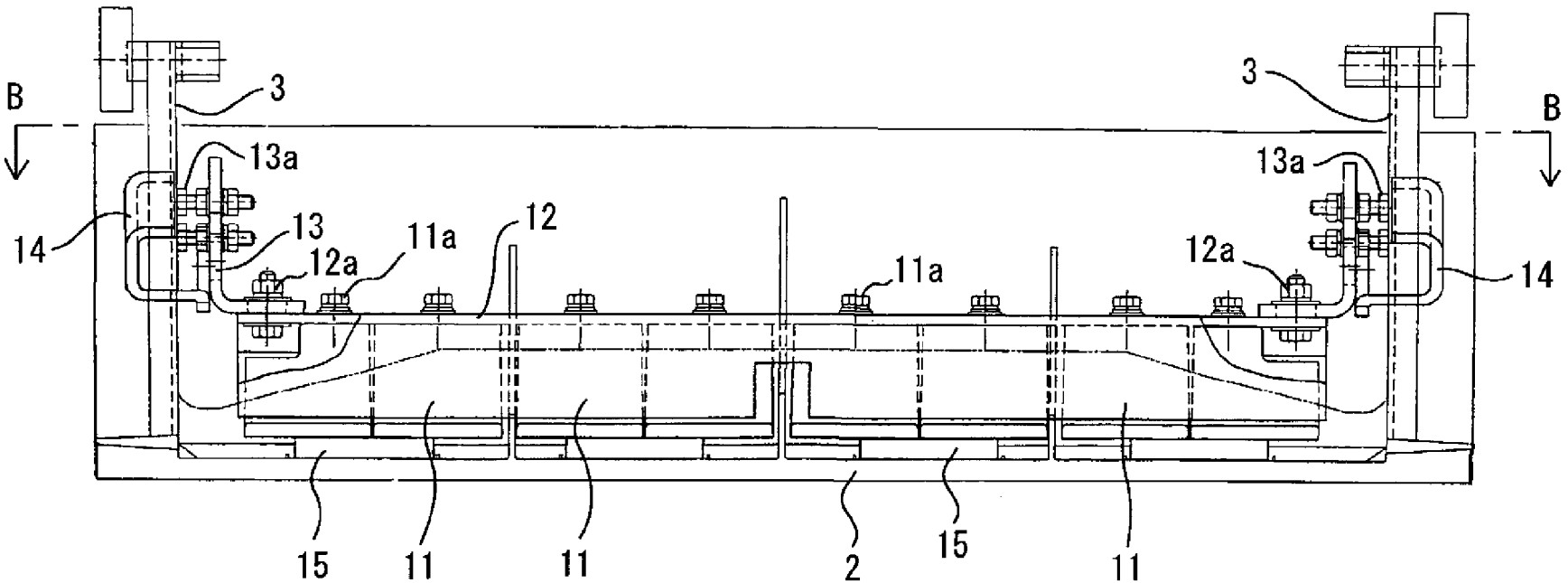
FIG. 2 is a front view of the step seen in the arrow A direction of FIG. 1.

As shown in FIG. 1 and FIG. 2, the plurality of weights 11 are placed on the rear surface of the tread 2 that forms the step 1 via rubber plates 15. These plurality of weights 11 are arranged in a row along the width of the step 1. The plurality of weights 11 abut at their respective ends on a reinforcement rib 5 projecting from the tread 2 of the step 1 as shown in FIG. 1, and are prevented from displacement relative to the step 1.

Figure 5:
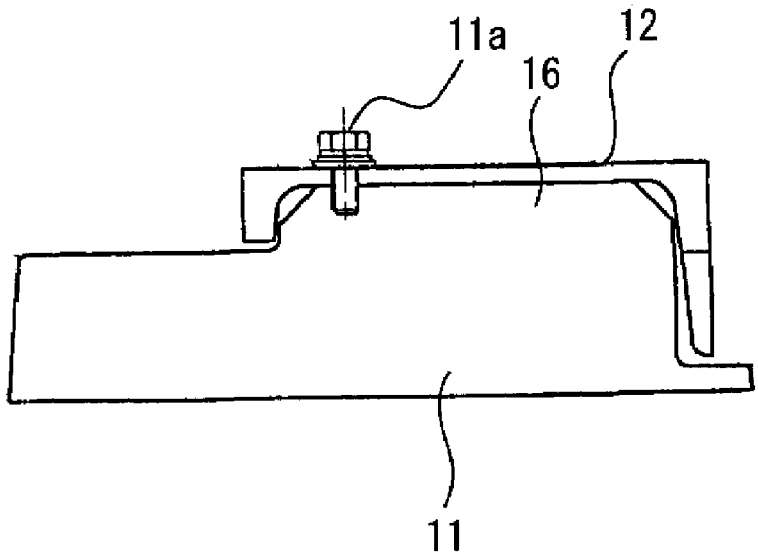
FIG. 5 is a sectional view of a weight and a channel along the D-D line of FIG. 3.

As shown in FIG. 5, each weight 11 has a projection 16 formed on the back face thereof. A channel member 12 of U-shape in cross section extending along the width of the step 1 is placed covering the plurality of weights 11, with a groove of the channel member 12 being fitted with the projection 16 of each of the weights 11. In this state, the channel member 12 is fastened to the back face of the weight 11 by a bolt 11*a*.

Figure 3:
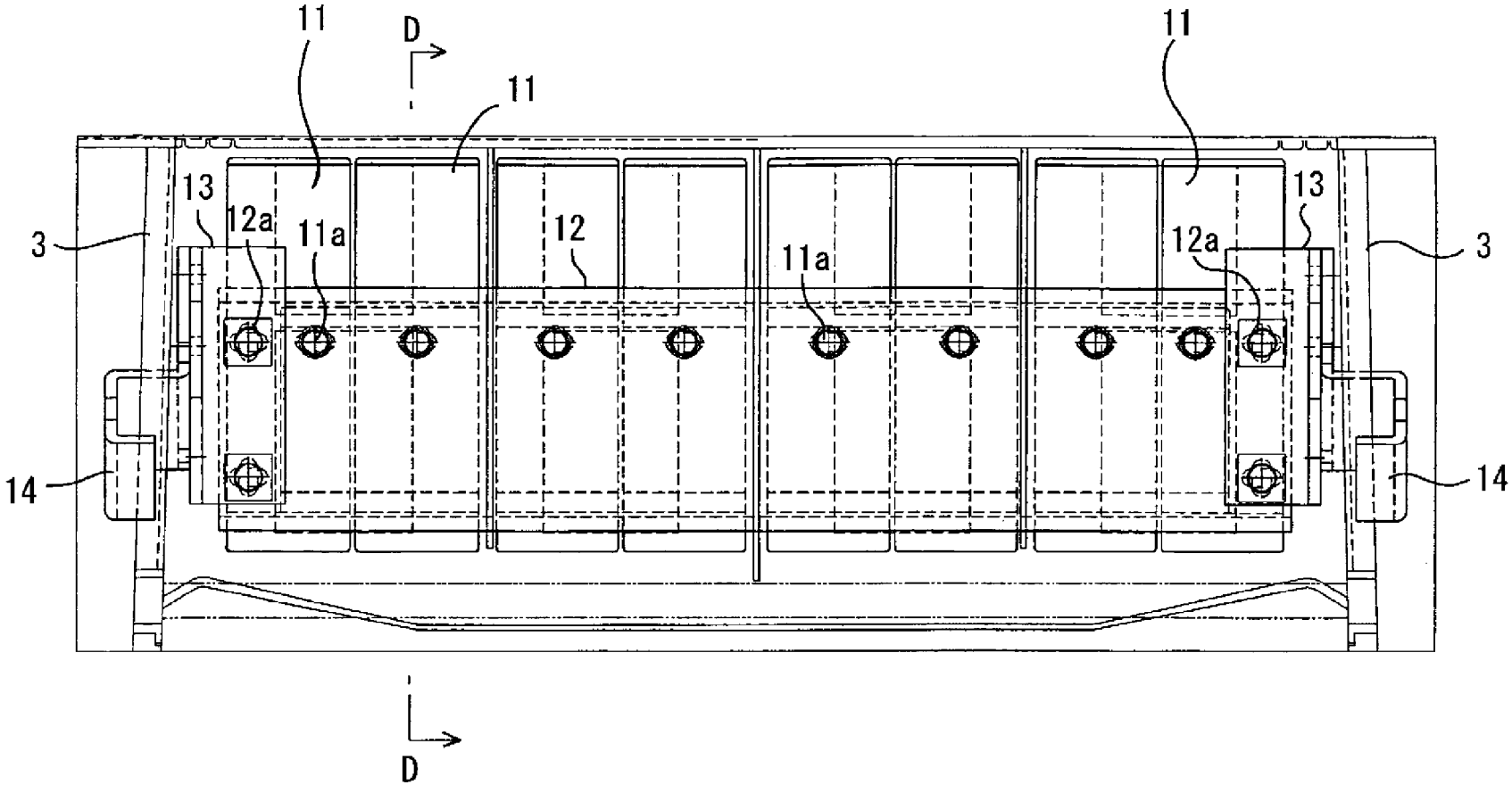
FIG. 3 is a plan view of the step along the B-B line of FIG. 2.

As shown in FIG. 2 and FIG. 3, an L-shaped bracket 13 is disposed at each side of the channel member 12, with the base end side of the bracket 13 being fastened to the channel member 12 by a bolt 12*a*. A pair of hangers 14, 14 are so disposed as to be opposed to the distal end sides of the respective brackets 13, 13, with a base end 18 of each hanger 14 being fastened to the distal end side of the bracket 13 by a bolt 14*a*, as shown in FIG. 1. The bolt 14*a* is passed through a long hole provided at the base end 18 of the hanger 14, which allows position adjustment of the bracket 13 relative to the hanger 14.

Figure 4:
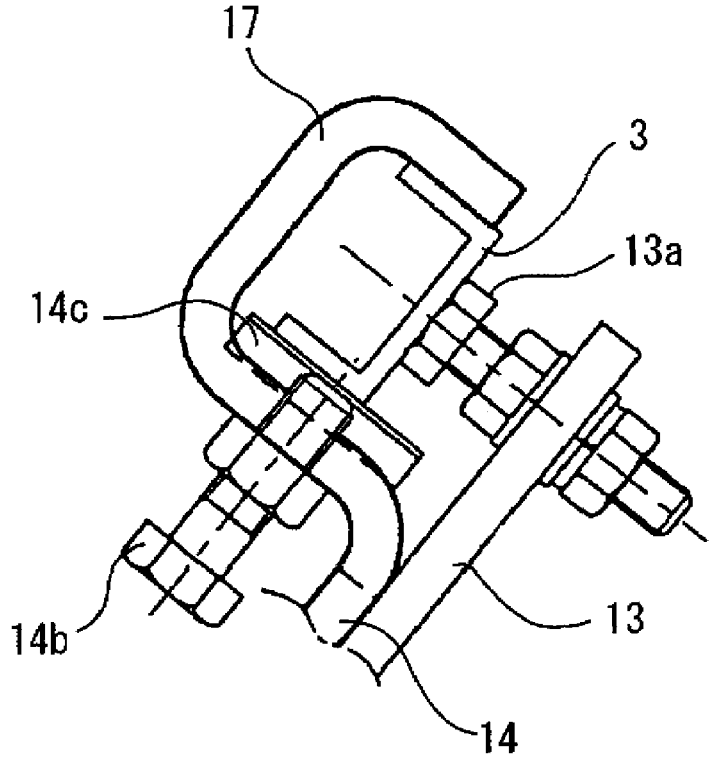
FIG. 4 is a sectional view of a bracket and a hanger along the C-C line of FIG. 1.

As shown in FIG. 4, a U-shaped portion 17 is formed at the distal end of the hanger 14. The yoke 3 and a press plate 14*c* are contained inside the U-shaped portion 17. The press plate 14*c* is pressed against the yoke 3 by the end of a bolt 14*b*, which is threadedly engaged with the hanger 14. The yoke 3 is thus pinched by the U-shaped portion 17 of the hanger 14. Tightening the bolt 14*b* will firmly connect the hanger 14 to the yoke 3.

A positioning bolt 13*a*, threadedly engaged with the bracket 13, abuts on the yoke 3 at the end thereof, whereby the hanger 14 is positioned relative to the yoke 3.

As described above, the plurality of weights 11 are placed on the rear surface of the tread 2 via the rubber plates 15, the plurality of weights 11 being engaged with the channel member 12 fixed to the yokes 3 via the brackets 13 and hangers 14, so that each of the weights 11 is supported by the channel member 12 on the rear surface of the tread 2. This prevents the weights 11 from moving relative to the step 1 even when the step 1 is repeatedly turned over in the process of its circulation.

Figure 6:
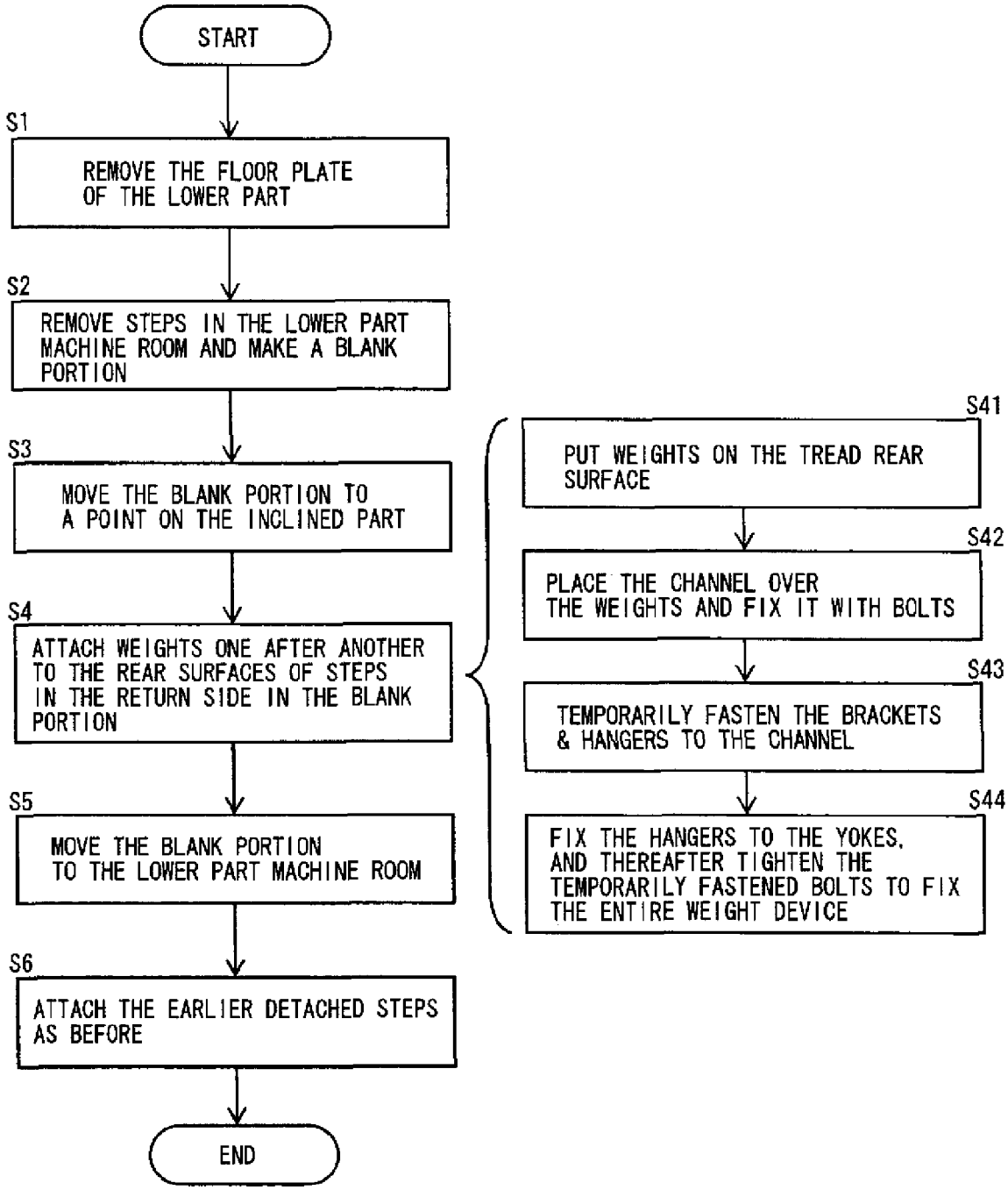
FIG. 6 is a flow chart showing the steps of attaching a weight in a step mechanism in accordance with the present invention.
Figure 7:
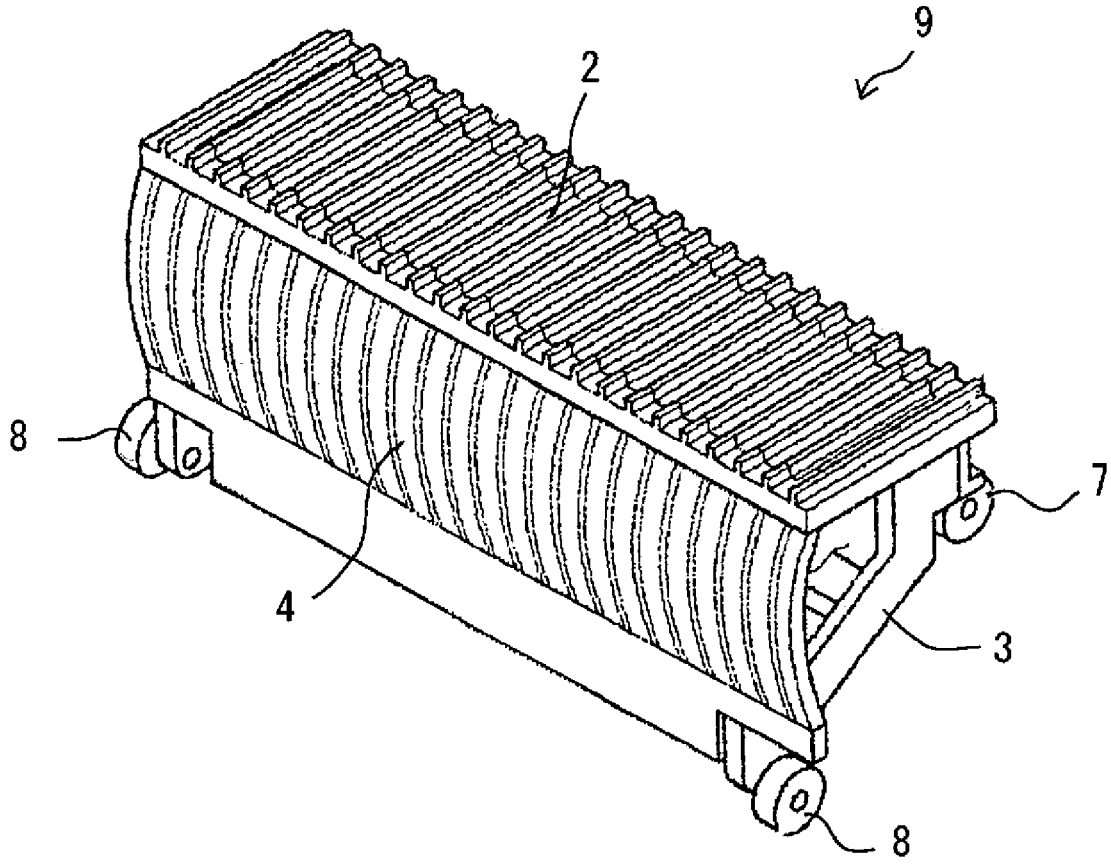
FIG. 7 PRIOR ART
FIG. 7 is a perspective view of a conventional step.

Next, the steps of incorporating the weight device 10 into the step 1 that forms the escalator will be described using FIG. 6.

In First, the floor plate of the lower part is removed, and a predetermined number of steps 1 are detached in the lower part machine room (S1), whereby a blank portion is provided (S2). Then, this blank portion with no step is moved to a point on the inclined part of the escalator (S3). Next, in this blank portion, weights 11 are attached one after another to the rear surfaces of the treads 2 of steps 1 in the return side in the following manner (S4).

First, each weight 11 is put on the rear surface of the tread 2 of a step 1 via a rubber plate 15 (S41). Even though the tread 2 slopes by around 30 degrees, the weight 11 does not slip because the weight 11 is received by the reinforcement rib 5. Next, the channel member 12 is placed over the weight 11, and then the channel member 12 is fixed to the weight 11 by the bolt 11*a* (S42). Further, bracket 13 and hanger 14 are temporarily fastened successively to the channel member 12 by the bolts 12*a*, 14*a* (S43). Next, the bolt 14*b* is tightened to press the press plate 14*c* and fix the hanger 14 to the yoke 3, and thereafter the temporarily fastened bolts 12*a*, 14*a* are tightened to fix the entire weight device 10 to the step 1 (S44). In this manner, weight devices 10 are attached to a predetermined number of steps 1.

Thereafter, the blank portion is moved to the lower part machine room (S5), and the earlier detached steps 1 are reattached as before (S6).

After the weight device 10 is attached to the step 1, the escalator can continuously operate, and any various durability tests, noise vibration tests, etc. with an actual load can be carried out. The number of steps 1 to which weight devices 10 are attached may vary depending on the purpose of the test. Weight devices may be attached to all the steps 1 of the escalator, or to about the half number of steps 1, or discontinuously attached with a certain number of steps being skipped.

The step mechanism in accordance with the present invention can undergo continuous load operation tests with the step being actually loaded. This can be helpful in verifying the durability or reliability of the driving system or guide system of the steps, and in improving component performance. Other items can be inspected such as the wear of each component, deformation, elongation of the chain, noise, vibration, influence of an unbalanced load, braking force, power consumption, current value, etc. under an actual load condition.

In the step mechanism of the present invention, the weight device 10 can be attached without additional work such as providing a hole in the step 1. This allows not only actual load tests in factories but also actual load tests at any installation sites to be conducted, and realizes an actual load test equipment of high versatility.

The present invention is not limited to the foregoing embodiment in construction but can be modified variously within the technical scope as set forth in the appended claims. For example, although in the above embodiment, the weights 11 are disposed along the rear surface of the tread 2 of the step 1, they may be attached, as well as this, to various places within the space surrounded by the tread 2, yoke 3 and riser 4. The structure for fixing the weights 11 is not limited to the embodiment, but may be various structures.

The invention claimed is:

1. A step mechanism in a transport device comprising a plurality of steps endlessly connected to circulate, wherein one or more of the steps have one or more weights detachably attached thereto, wherein the weights are disposed at a plurality of locations of each of the steps, and these plurality of weights are fixed to the rear side of a tread in a row by a channel member of U-shape in cross section, with a projection formed on the back face of each of the weights being fitted in a groove of the channel member.

2. The step mechanism according to claim 1, wherein a pair of hangers are arranged at the opposite sides of the channel member and connected to the yoke of each of the steps while pinching the yoke, and the opposite ends of the channel member are fixed to the yoke of each of the steps via the pair of hangers.

3. The step mechanism according to claim 2, wherein the either end of the channel member is connected to each of the hangers via a bracket.

4. The step mechanism according to claim 3, wherein the channel member is in engagement with the back faces of the weights, and the channel member is fastened to the back faces of the weights by bolts, with the bracket being fastened to the either end of the channel member by a bolt, the base end of each of the hangers being fastened to the bracket by a bolt, each of the hangers having a U-shaped portion formed at the distal end thereof, the yoke being contained in the U-shaped portion, and the yoke being pinched by a bolt.

5. The step mechanism according to claim 4, wherein the positioning bolt, threadedly engaged with the bracket, abuts on the yoke at the end thereof, whereby each of the hangers is positioned relative to the yoke.

* * * * *